US007397440B1

(12) United States Patent
Horner et al.

(10) Patent No.: US 7,397,440 B1
(45) Date of Patent: Jul. 8, 2008

(54) EXTENDED PHASE CENTER TAPERED SLOT ANTENNA

(75) Inventors: Rob Horner, San Diego, CA (US); Dennis Bermeo, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/645,258

(22) Filed: Nov. 27, 2006

(51) Int. Cl.
*H01Q 13/10* (2006.01)

(52) U.S. Cl. ..... 343/770; 343/767; 343/768

(58) Field of Classification Search ..... 343/767, 343/768, 770, 700 MS
See application file for complete search history.

(56) References Cited

U.S. PATENT DOCUMENTS

| | | | | |
|---|---|---|---|---|
| 5,268,696 | A * | 12/1993 | Buck et al. | 342/372 |
| 6,847,332 | B2 * | 1/2005 | Thudor et al. | 343/767 |
| 6,967,624 | B1 * | 11/2005 | Hsu et al. | 343/770 |
| 7,088,300 | B2 * | 8/2006 | Fisher | 343/767 |

* cited by examiner

*Primary Examiner*—Hoang V Nguyen
(74) *Attorney, Agent, or Firm*—Peter A. Lipovsky; Arthur K. Samora; J. Eric Anderson

(57) ABSTRACT

A Extended Phase Center Tapered Slot Antenna (NC#97529). The apparatus includes a first antenna element capable of transmitting and receiving radio frequency energy; a second antenna element capable of transmitting and receiving radio frequency energy, wherein the first antenna element and the second antenna element are situated in a tapered slot antenna pair configuration; and at least one conductive launch structure, electrically coupled to the first antenna element and the second antenna element at a location between a lowest operating frequency phase center and a launch end of the tapered slot antenna pair configuration, capable of conducting electricity.

17 Claims, 8 Drawing Sheets

200

Front View

Front View

Front View

200

200

Front View (Note: FIGS 3A-3B are NOT drawn to scale relative to each other)

300

(Note: FIGS 3A-3B are NOT drawn to scale relative to each other)

Top View

300

400

500

EXTENDED PHASE CENTER TAPERED SLOT ANTENNA

FEDERALLY SPONSORED RESEARCH AND DEVELOPMENT

This invention (Navy Case No. 97529) is assigned to the United States Government and is available for licensing for commercial purposes. Licensing and technical inquiries may be directed to the Office of Research and Technical Applications, Space and Naval Warfare Systems Center, San Diego, Code 2112, San Diego, Calif., 92152; voice (619) 553-2778; email T2@spawar.navy.mil. Reference Navy Case Number 97529.

CROSS-REFERENCE TO RELATED APPLICATIONS

This application is related to U.S. Pat. No. 7,009,572, issued on Mar. 7, 2006, entitled "Tapered Slot Antenna", by Rob HORNER et al., Navy Case No. 96507, which is hereby incorporated by reference in its entirety herein for its teachings on antennas. This application is also related to U.S. Ser. No. 11/472,514 filed on Jun. 15, 2006, entitled "Tapered Slot Antenna Cylindrical Array", by Rob HORNER et al., Navy Case No. 97194, which is hereby incorporated by reference in its entirety herein for its teachings on antennas. This application is also related to U.S. Ser. No. 11/482,301 filed on Jun. 27, 2006, entitled "Tapered Slot Antenna Cylindrical Array", by Rob HORNER et al., Navy Case No. 98219, which is hereby incorporated by reference in its entirety herein for its teachings on antennas.

BACKGROUND OF THE INVENTION

The present invention is generally in the field of antennas.

Typical tapered slot antennas (TSA) have a relatively short phase center when operating at frequencies below a theoretical cutoff frequency. Thus, typical TSA have limited capabilities when operating as broadband antennas.

A need exists for TSA having a relatively long phase center when operating at frequencies below a theoretical cutoff frequency. An exemplary need exists for antennas used in direction finding applications.

BRIEF DESCRIPTION OF THE DRAWINGS

All FIGURES are not drawn to scale.

DETAILED DESCRIPTION OF THE INVENTION

Figures 1A, 1B:
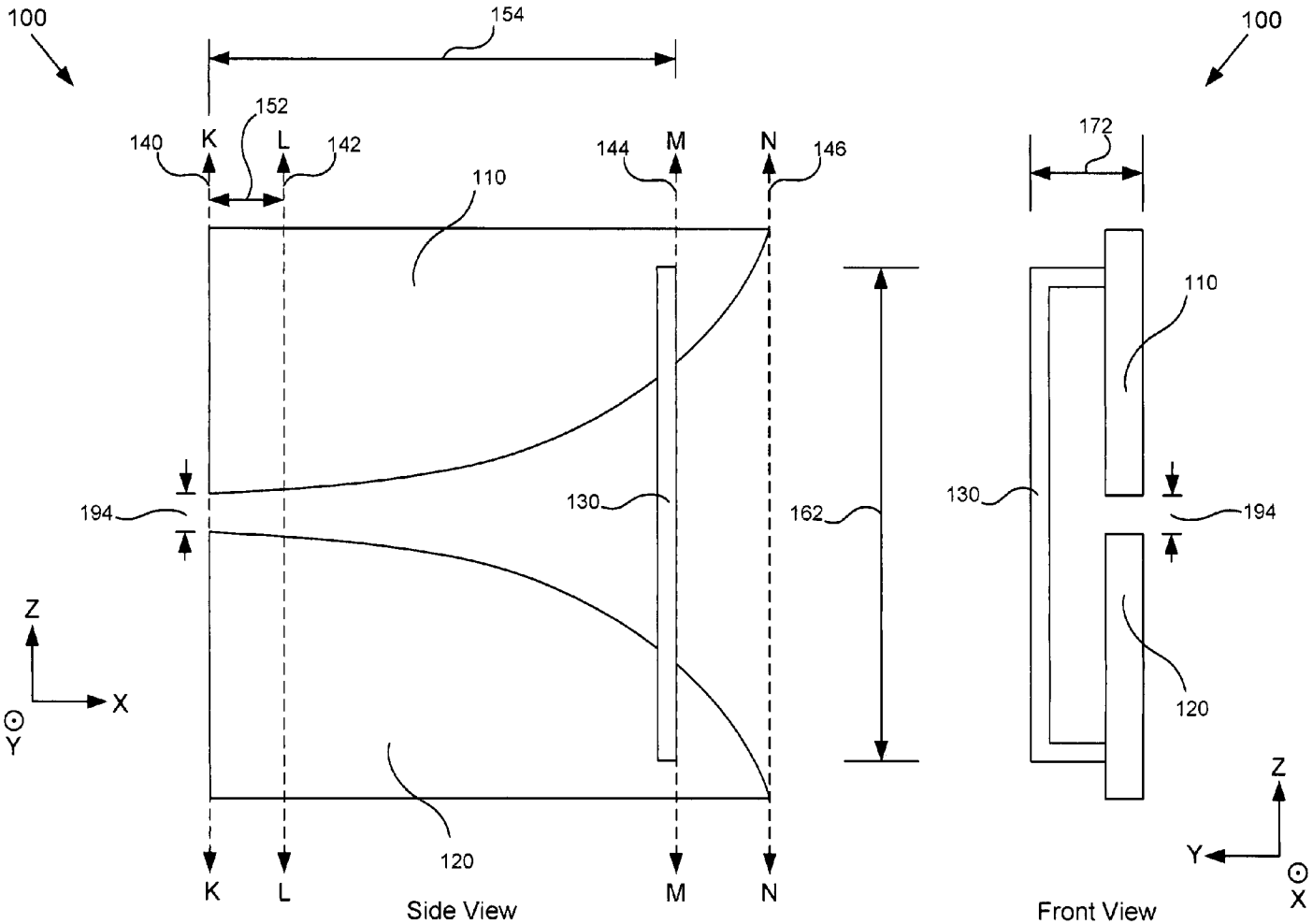
FIG. 1A is a side view of one embodiment of an EPCTSA.
FIG. 1B is a front view of one embodiment of an EPCTSA.

The present invention is directed to Extended Phase Center Tapered Slot Antennas.

DEFINITIONS

The following acronyms and definition(s) are used herein:

Acronym(s):

AE—Antenna Element(s)

EPCTSA—Extended Phase Center Tapered Slot Antenna

LOF—Lowest Operating Frequency

RF—Radio Frequency

TSA—Tapered Slot Antenna(s)

DEFINITION(S)

Conductive Launch Structure—a structure that is capable of conducting electricity between antenna elements of an antenna pair or multiple antenna pairs of a TSA or TSA array; the structure located along an axis between a LOF phase center and a launch end of a TSA; the structure extends phase center of a TSA beyond LOF ordinary phase center (i.e., toward a launch end)

Feed End—Portion of a TSA from which an input signal is received

Launch End—Portion of a TSA distal to the feed end

Lowest Operating Frequency—theoretical cutoff frequency for a TSA having specific dimensions (and not having a conductive launch structure)

Lowest Operating Frequency (LOF) Phase Center—phase center for frequencies lower than the theoretical cutoff frequency for a TSA having specific dimensions regardless of having a conductive launch structure Lowest Operating Frequency Extended Phase Center—phase center for frequencies lower than the theoretical cutoff frequency for a TSA having specific dimensions, wherein the TSA has a conductive launch structure; (the conductive launch structure creates a new launch point or phase center)

Lowest Operating Frequency Ordinary Phase Center—phase center for frequencies lower than the theoretical cutoff frequency for a TSA having specific dimensions, wherein the TSA does not have a conductive launch structure Phase Center—location on a TSA representing a launch point of RF energy from the TSA relative to a feed axis;

Theoretical Cutoff Frequency—a frequency at which an antenna's largest dimension (or antenna height) is greater than or equal to half of the respective wavelength The extended phase center tapered slot antenna (EPCTSA) includes at least one tapered slot antenna (TSA). The at least one TSA includes two antenna elements (AE) and a conductive launch structure that electrically couples the two AE at a location between a lowest operating frequency (LOF) ordinary phase center (i.e., phase center for frequencies lower than the theoretical cutoff frequency for a TSA) and a launch end of the at least one TSA. In one embodiment, the conductive launch structure comprises a single loop. In one embodiment, the conductive launch structure comprises a double loop. In one embodiment, the conductive launch structure comprises a square loop. In one embodiment, the conductive launch structure comprises a curved loop. In one embodiment, the EPCTSA comprises two TSA, wherein each TSA comprises two AE and a conductive launch structure that electrically couples the two AE at a location between a LOF ordinary phase center and a launch end of the TSA. In one embodiment, the EPCTSA comprises two TSA, wherein a conductive launch structure electrically couples all four AE. In one embodiment, the conductive launch structure comprises conductive material and at least one lump sum (passive) circuit element. In one embodiment, the EPCTSA comprises sixteen TSA having a cylindrical array configuration, wherein each TSA comprises two AE and a conductive launch structure that electrically couples the two AE at a location between a LOF ordinary phase center and a launch end of the TSA.

FIG. 1A is a side view of one embodiment of an EPCTSA. As shown in FIG. 1A, EPCTSA 100 includes an antenna pair (i.e., antenna element 110, antenna element 120) and conductive launch structure 130. The antenna pair of EPCTSA 100 has gap height 194, a feed end and a launch end. The feed end of the antenna pair corresponds to the portion of the antenna pair that is proximate to axis 140 (represented by dashed line K-K on FIG. 1A). The feed end receives and transmits signals. The launch end of the antenna pair corresponds to the portion of the antenna pair that is proximate to axis 146 (represented by dashed line N-N on FIG. 1A). Note that the launch end only denotes a location on the antenna pair versus an actual launch point of a particular frequency. The feed end can be operatively coupled to an input/output (I/O) feed such as a coaxial cable. An I/O feed can be used to transmit and receive RF signals to and from EPCTSA 100. RF signals can be transmitted from the feed end toward the launch end, wherein the RF signals launch from the antenna pair at a point between the feed end and the launch end depending on the signal frequency. RF signals having higher frequencies (and are greater than the LOF) launch closer to the feed end and RF signals having lower frequencies (and are greater than the LOF) launch closer to the launch end.

In one embodiment, AE 110, 120 have curvatures that can each be represented by the following Equation 1:

$$Y(x)=a(e^{bx}-1); \quad \text{(Equation 1)}$$

where, a and b are parameters selected to produce a desired curvature.

In one embodiment, parameters "a" and "b" are approximately equal to 0.2801 and 0.1028, respectively.

Conductive launch structure 130 electrically couples antenna element 110 and antenna element 120 at a location between a LOF ordinary phase center (which can be represented by the intersection of the curved edges of AE 110, 120 and dashed line L-L 142 on FIG. 1A) and the launch end. The LOF ordinary phase center is a phase center for frequencies lower than the theoretical cutoff frequency for a TSA having specific dimensions (and not having a conductive launch structure). Thus, for TSA that do not have conductive launch structures, frequencies lower than the theoretical cutoff frequency launch at locations proximate to the intersection of the LOF ordinary phase center. The distance between the LOF ordinary phase center and the feed end (relative to the X-axis) is typically a relatively short distance (depicted by length 152 in FIG. 1A) and varies depending on TSA dimensions and frequency of interest. For example, a TSA having the dimensions of 12 inches by 12 inches has a LOF ordinary phase center approximately 4.5 inches from the feed end (toward the launch end) along the X-axis in FIG. 1A.

Conductive launch structure 130 comprises a conductive material. In EPCTSA 100, the distance between the LOF extended phase center (which can be represented by the intersection of the curved edges of AE 110, 120 and dashed line M-M 144 on FIG. 1A) and the feed end (relative to the X-axis) is a distance (depicted by length 154 in FIG. 1A) that is longer than length 152. Conductive launch structure 130 has a launch structure height (depicted by length 162 in FIG. 1A).

FIG. 1B is a front view of one embodiment of an EPCTSA. EPCTSA 100 of FIG. 1B is substantially similar to EPCTSA 100 of FIG. 1A, and thus, similar components are not described again in detail hereinbelow. EPCTSA 100 of FIG. 1B depicts a conductive launch structure having a single square loop configuration. As shown in FIG. 1B, EPCTSA 100 includes an antenna pair (i.e., antenna element 110, antenna element 120) and conductive launch structure 130. The antenna pair of EPCTSA 100 has gap height 194. Conductive launch structure 130 has a launch structure width (depicted by length 172 in FIG. 1B).

Figure 1E:
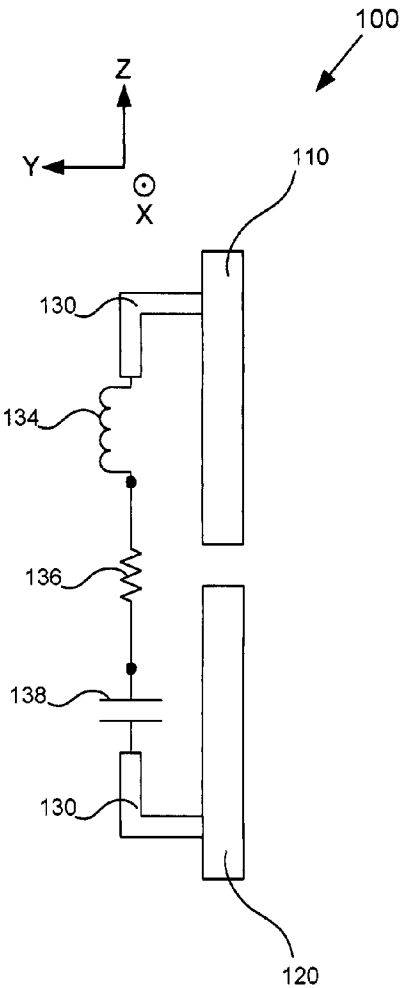
FIG. 1E is a front view of one embodiment of an EPCTSA.
Figure 1D:
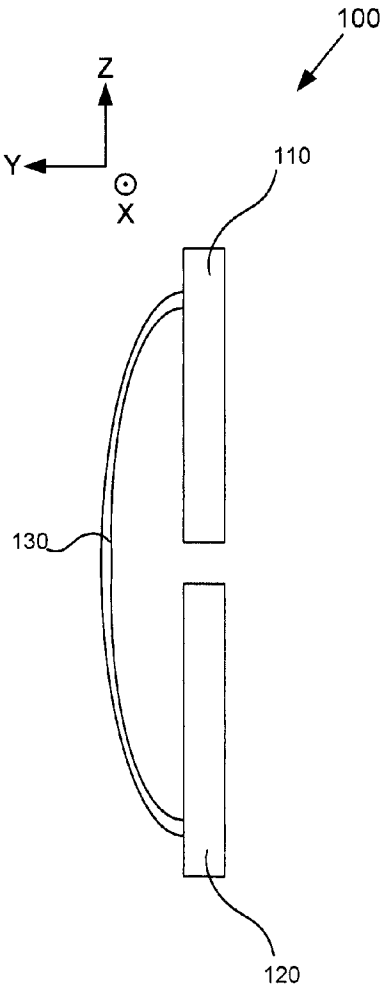
FIG. 1D is a front view of one embodiment of an EPCTSA.
Figure 1C:
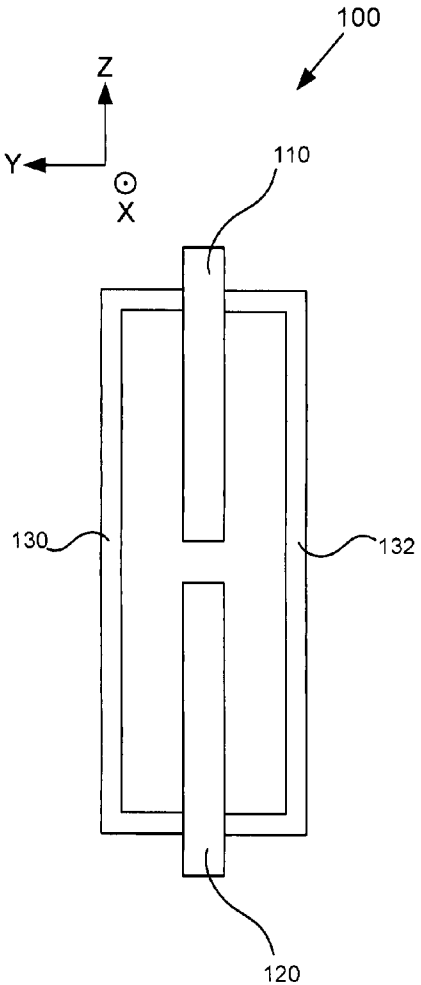
FIG. 1C is a front view of one embodiment of an EPCTSA.

FIG. 1C is a front view of one embodiment of an EPCTSA. EPCTSA 100 of FIG. 1C is substantially similar to EPCTSA 100 of FIG. 1A, and thus, similar components are not described again in detail hereinbelow. EPCTSA 100 of FIG. 1C depicts a conductive launch structure having a double square loop configuration. As shown in FIG. 1C, EPCTSA 100 includes an antenna pair (i.e., antenna element 110, antenna element 120) and conductive launch structures 130, 132. Conductive launch structures 130, 132 both comprise conductive material. As shown in FIG. 1C, conductive launch structures 130, 132 have a square loop configuration. Conductive launch structures 130, 132 are situated on AE 110, 120 at approximately equal distances from the launch end of EPCTSA 100 with respect to the X-axis. Those of ordinary skill in the art shall recognize that conductive launch structures 130, 132 can be situated on AE 110, 120 at unequal distances from the launch end of EPCTSA 100 with respect to the X-axis without departing from the scope or spirit of the present EPCTSA.

FIG. 1D is a front view of one embodiment of an EPCTSA. EPCTSA 100 of FIG. 1D is substantially similar to EPCTSA 100 of FIG. 1A, and thus, similar components are not described again in detail hereinbelow. EPCTSA 100 of FIG. 1D depicts a conductive launch structure having a curved loop configuration. Conductive launch structure 130 comprises conductive material. As shown in FIG. 1D, conductive launch structure 130 has a curved loop configuration.

FIG. 1E is a front partial schematic view of one embodiment of an EPCTSA. EPCTSA 100 of FIG. 1E is substantially similar to EPCTSA 100 of FIG. 1A, and thus, similar components are not described again in detail hereinbelow. EPCTSA 100 of FIG. 1E depicts a conductive launch structure having a lump sum (passive) circuit element configuration. Conductive launch structure 130 comprises conductive material. As shown in FIG. 1E, conductive launch structure 130 further comprises inductor 134, resistor 136 and capacitor 138. In one embodiment, lump sum circuit elements (e.g., inductors, resistors and capacitors) are used to control a transition frequency (i.e., frequency at which RF energy encounters an equal impedance match between AE 110, 120 and conductive launch structure 130) of EPCTSA 100. In one embodiment, a combination of at least two of the following components are used to control a transition frequency: inductor, resistor and capacitor. In one embodiment, lump sum circuit elements are designed to create a low-pass filter effect for conductive launch structure 130. In one embodiment, lump sum circuit elements are designed to create a high-pass filter effect for conductive launch structure 130. In one embodiment, lump sum circuit elements are designed to create a bandpass filter effect for conductive launch structure 130.

Figure 2A:
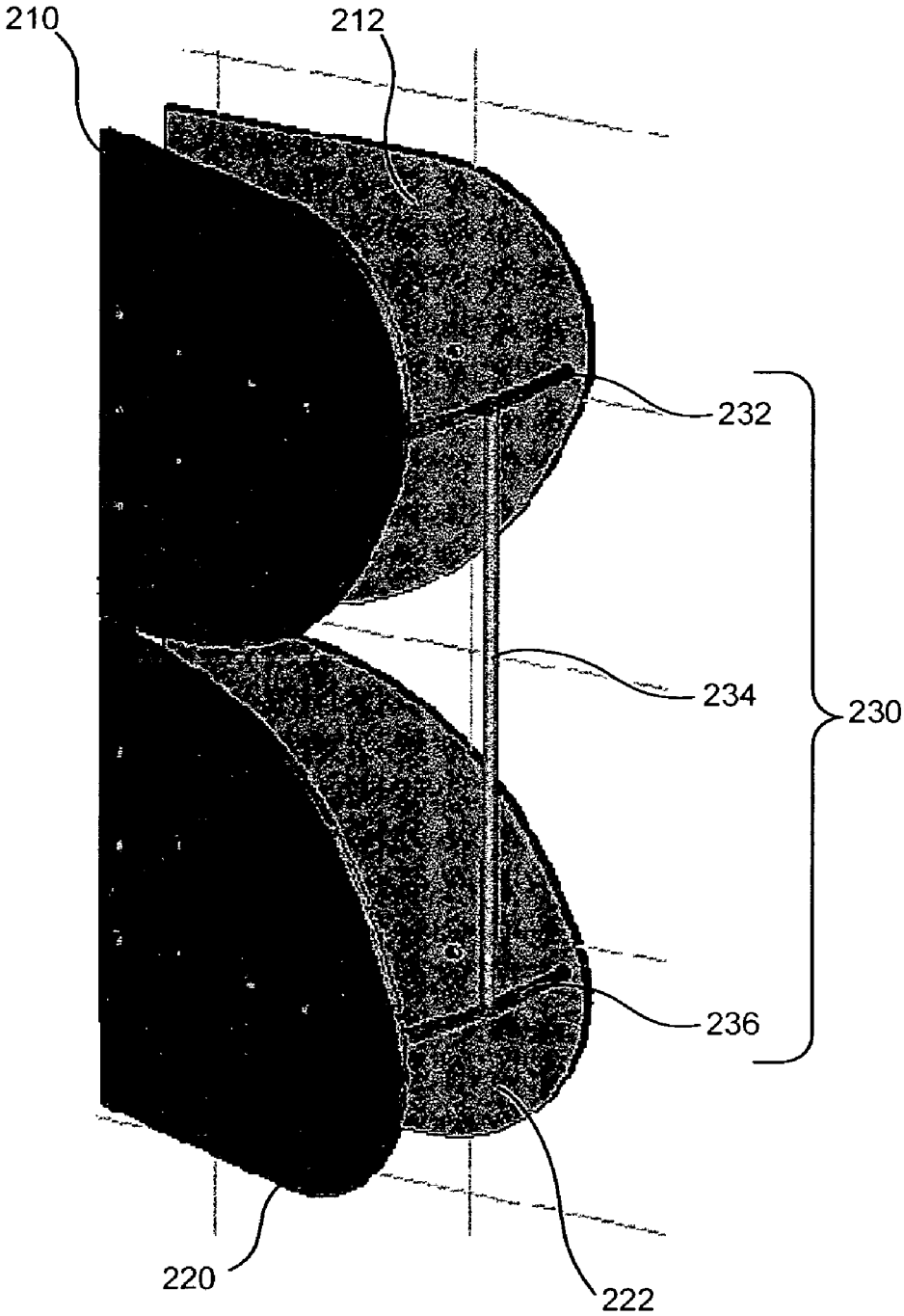
FIG. 2A is a perspective view of one embodiment of an EPCTSA.
Figure 2B:
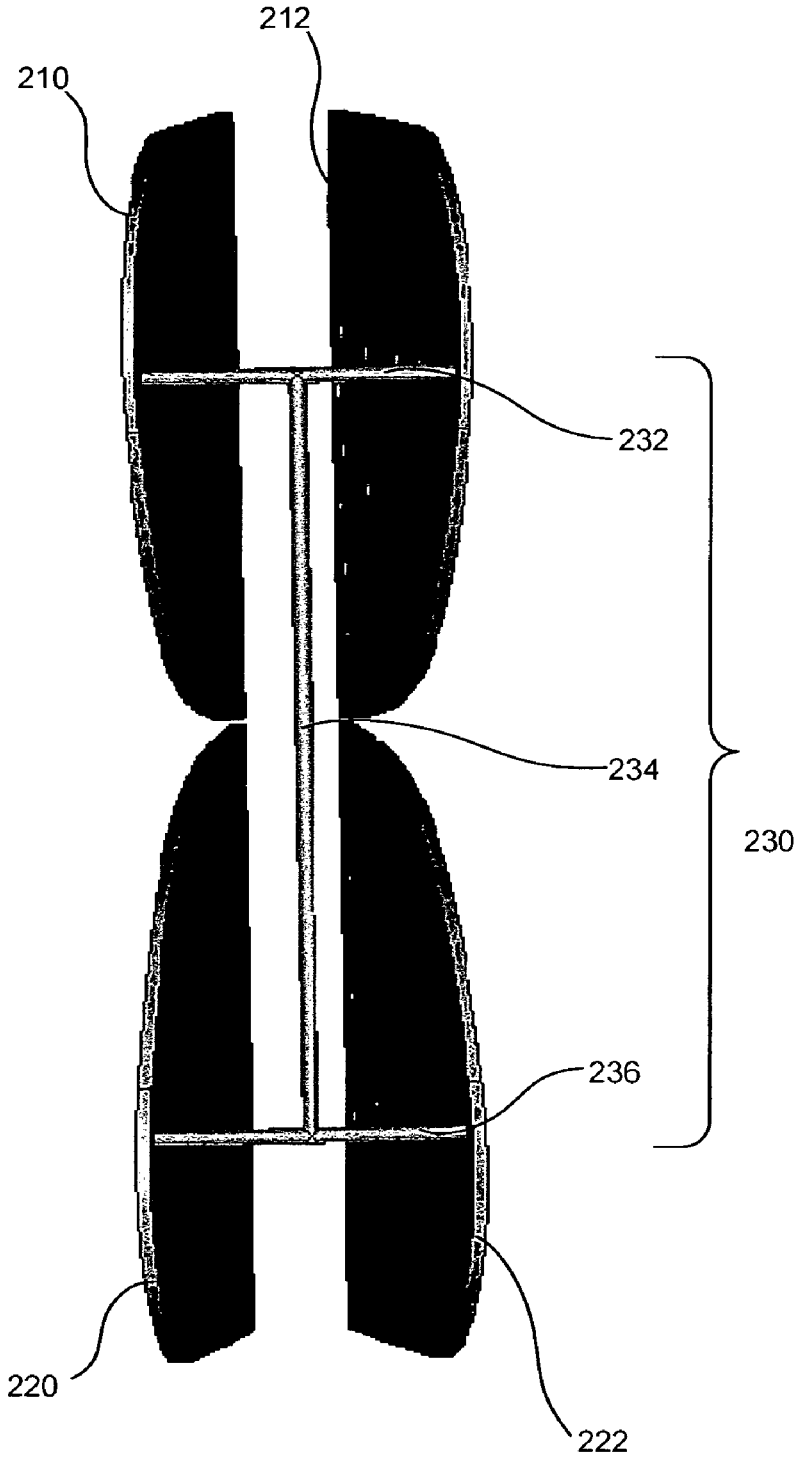
FIG. 2B is a top view of one embodiment of an EPCTSA.

FIG. 2A is a perspective view of one embodiment of an EPCTSA. EPCTSA 200 of FIG. 2A has a double TSA, single conductive launch structure configuration. FIG. 2B is a top view of one embodiment of an EPCTSA of FIG. 2A. As shown in FIGS. 2A and 2B, a first TSA comprises AE 210, 220 and a second TSA comprises AE 212, 222. Conductive launch structure 230 electronically couples AE 210, 220, 212, 222. Conductive launch structure 230 comprises conductive elements 232, 234, 236. Conductive element 232 is operatively coupled to AE 210, 212. Conductive element 236 is operatively coupled to AE 220, 222. Conductive element 234 is operatively coupled to conductive elements 232, 236.

Figure 3A:
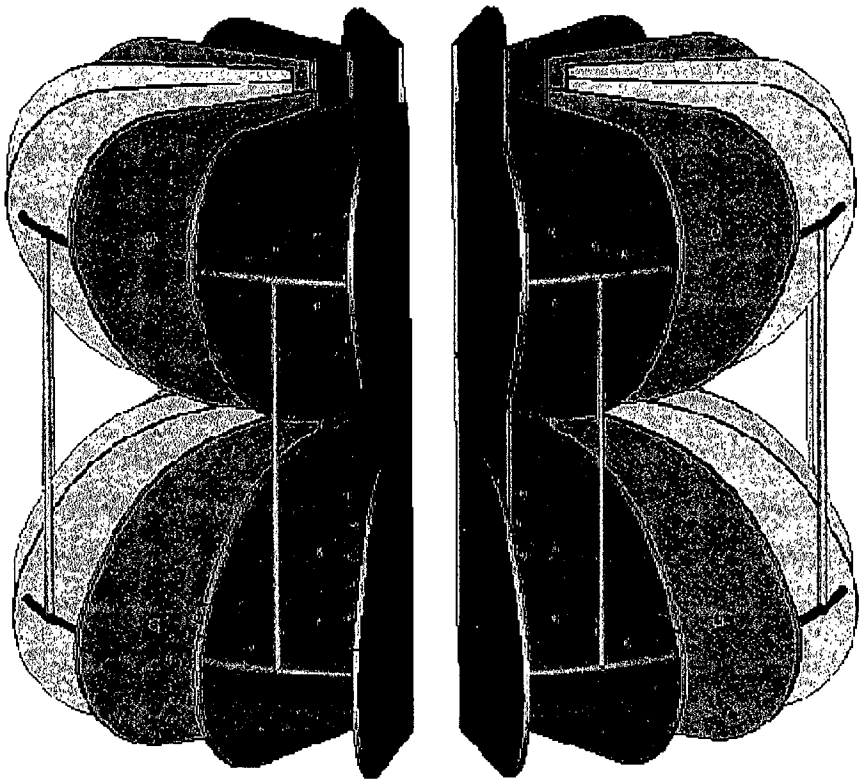
FIG. 3A is a perspective view of one embodiment of an EPCTSA cylindrical array.

FIG. 3A is a perspective view of one embodiment of an EPCTSA cylindrical array. EPCTSA 300 of FIG. 3A depicts an EPCTSA cylindrical array having a multiple double TSA, single conductive launch structure configuration. As shown in FIG. 3A, EPCTSA cylindrical array 300 comprises eight conductive launch structures and sixteen TSA having a cylindrical configuration. In one embodiment, EPCTSA cylindrical array 300 comprises eight EPCTSA 200 of FIG. 2A having a cylindrical configuration, wherein each conductive launch structure of said eight conductive launch structures electrically couples a unique pair of said sixteen tapered slot antennas.

Figure 3B:
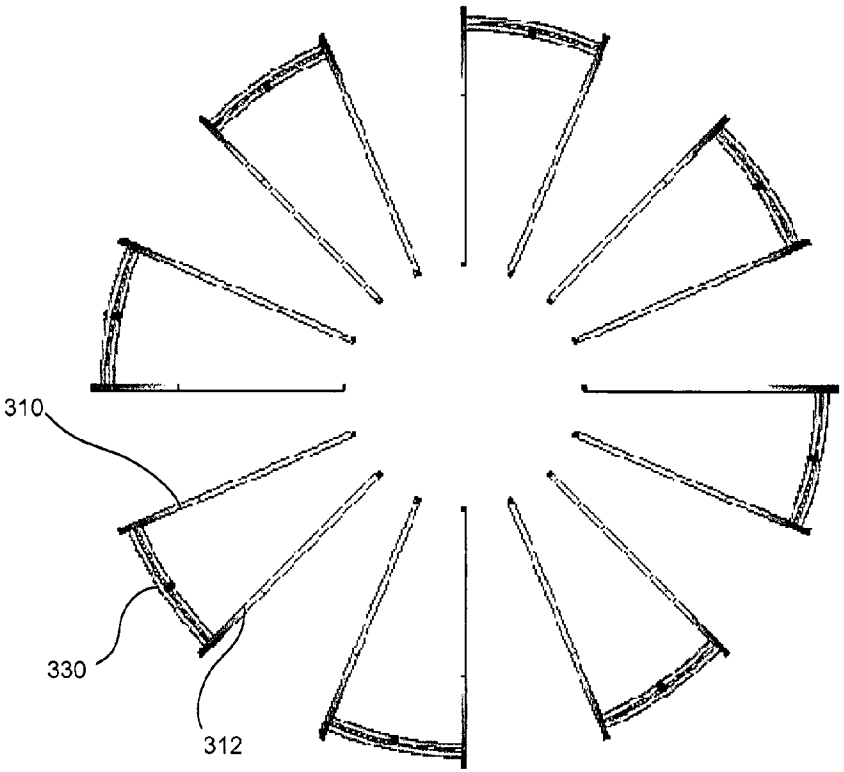
FIG. 3B is a top view of one embodiment of an EPCTSA cylindrical array.

FIG. 3B is a top view of one embodiment of an EPCTSA cylindrical array of FIG. 3A. EPCTSA cylindrical array 300 of FIG. 3B is substantially similar to EPCTSA cylindrical array 300 of FIG. 3A, and thus, similar components are not described again in detail hereinbelow. AE 310 of FIG. 3B is analogous to AE 210 of FIGS. 2A and 2B. AE 312 of FIG. 3B is analogous to AE 212 of FIGS. 2A and 2B. Conductive launch structure 330 of FIG. 3B is analogous to conductive launch structure 230 of FIGS. 2A and 2B.

Figure 4:
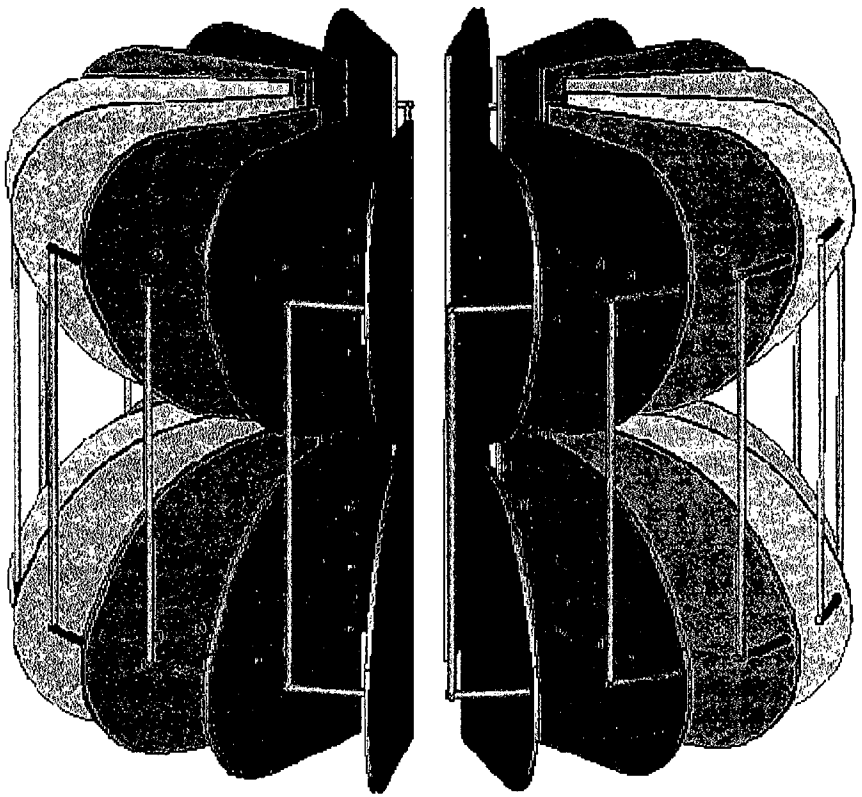
FIG. 4 is a perspective view of one embodiment of an EPCTSA cylindrical array.

FIG. 4 is a perspective view of one embodiment of an EPCTSA cylindrical array. EPCTSA 400 of FIG. 4 depicts an EPCTSA cylindrical array having multiple TSA, wherein each TSA has a conductive launch structure having a single square loop configuration. As shown in FIG. 4, EPCTSA cylindrical array 400 comprises sixteen conductive launch structures and sixteen TSA having a cylindrical configuration. In one embodiment, EPCTSA cylindrical array 400 comprises sixteen EPCTSA 100 of FIGS. 1A and 1B having a cylindrical configuration.

Figure 5:
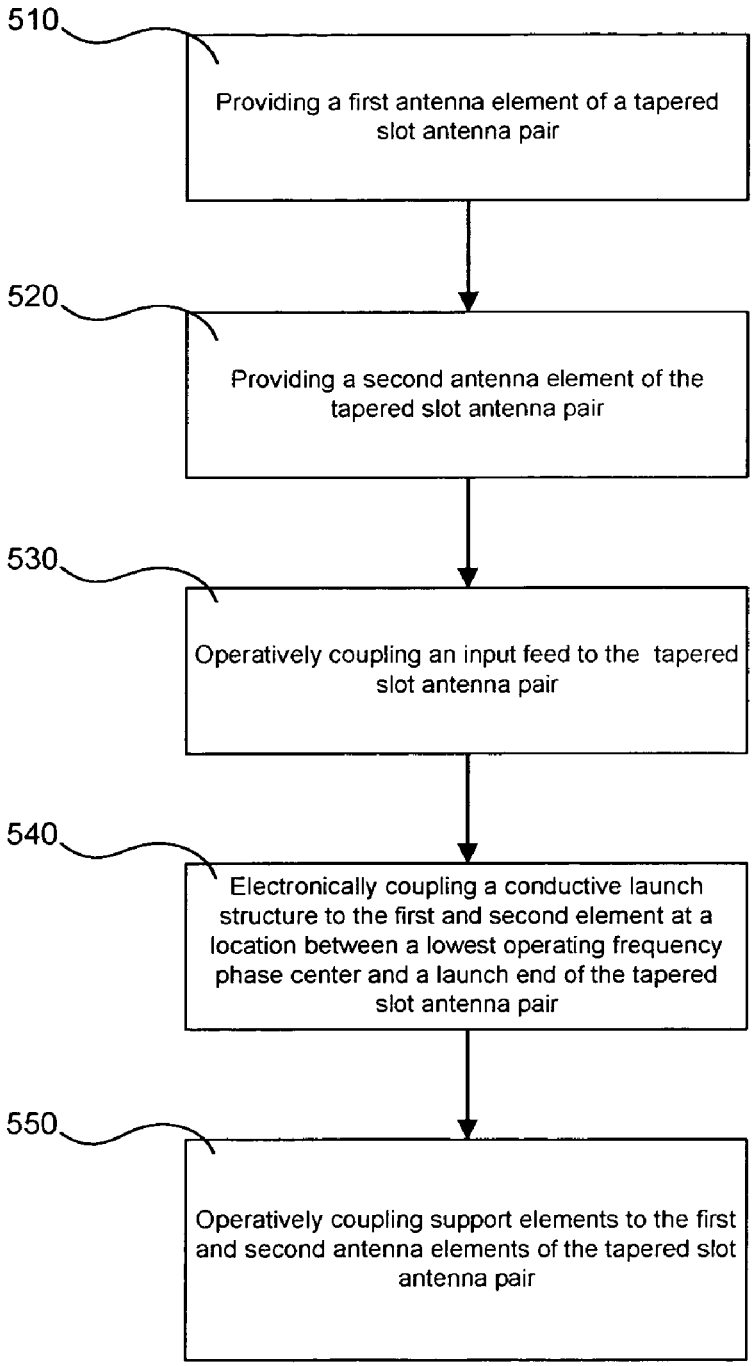
FIG. 5 is a flowchart of an exemplary method of manufacturing one embodiment of an EPCTSA.

FIG. 5 is a flowchart of an exemplary method of manufacturing one embodiment of an EPCTSA. Boxes 510, 520, 530, 540, 550 of flowchart 500 of FIG. 5 show an exemplary method of manufacturing one embodiment of an EPCTSA. While flowchart 500 is sufficient to describe one embodiment of an exemplary EPCTSA, other embodiments of the EPCTSA may utilize procedures different from those shown in flowchart 500.

We claim:

1. An apparatus, comprising:

a first antenna element capable of transmitting and receiving radio frequency energy;

a second antenna element capable of transmitting and receiving radio frequency energy, wherein said first antenna element and said second antenna element are situated in a tapered slot antenna pair configuration, wherein the tapered slot antenna pair configuration comprises:

a launch end, and a feed end configured to be operatively coupled to an input/output feed;

at least one conductive launch structure, directly coupled to, and forming an electrical connection between, said first antenna element and said second antenna element at a location between a lowest operating frequency phase center and said launch end.

2. The apparatus of claim 1, wherein said at least one conductive launch structure has a single square loop configuration.

3. The apparatus of claim 1, wherein said at least one conductive launch structure has a double square loop configuration.

4. The apparatus of claim 1, wherein said at least one conductive launch structure has a curved loop configuration.

5. The apparatus of claim 1, wherein said at least one conductive launch structure has a lump sum circuit element configuration.

6. The apparatus of claim 5, wherein said at least one conductive launch structure comprises a lump sum circuit element selected from the group consisting of inductor, resistor and capacitor.

7. The apparatus of claim 5, wherein said at least one conductive launch structure comprises a combination of at least two lump sum circuit elements selected from the group consisting of inductor, resistor and capacitor.

8. The apparatus of claim 5, wherein said lump sum circuit element configuration creates a low pass filter effect.

9. The apparatus of claim 1, wherein said apparatus has a double tapered slot antenna, single conductive launch structure configuration, wherein said apparatus comprises a first tapered slot antenna, a second tapered slot antenna and a conductive launch structure electrically coupled to said first tapered slot antenna and said second tapered slot antenna.

10. The apparatus of claim 1, wherein said apparatus comprises an extended phase center tapered slot antenna cylindrical array having a multiple double tapered slot antenna, single conductive launch structure configuration.

11. The apparatus of claim 10, wherein said apparatus comprises eight conductive launch structures and sixteen tapered slot antennas having a cylindrical configuration, wherein each conductive launch structure of said eight conductive launch structures electrically couples a unique pair of said sixteen tapered slot antennas.

12. The apparatus of claim 10, wherein said apparatus further includes base elements operatively coupled to said multiple double tapered slot antenna, capable of providing structural support for said multiple double tapered slot antenna.

13. The apparatus of claim 1, wherein said apparatus comprises an extended phase center tapered slot antenna cylindrical array having multiple tapered slot antennas, wherein each tapered slot antenna has a conductive launch structure having a single square loop configuration.

14. The apparatus of claim 13, wherein said apparatus comprises sixteen conductive launch structures and sixteen tapered slot antennas having a cylindrical configuration, wherein each conductive launch structure of said sixteen conductive launch structures electrically couples to a unique tapered slot antenna of said sixteen tapered slot antennas.

15. The apparatus of claim 13, wherein said apparatus further includes base elements operatively coupled to said multiple double tapered slot antenna, capable of providing structural support for said multiple double tapered slot antenna.

16. An apparatus, comprising:

a first antenna element capable of transmitting and receiving radio frequency energy;

a second antenna element capable of transmitting and receiving radio frequency energy, wherein said first antenna element and said second antenna element are situated in a tapered slot antenna pair configuration; a first antenna element capable of transmitting and receiving radio frequency energy;

a third antenna element capable of transmitting and receiving radio frequency energy;

a fourth antenna element capable of transmitting and receiving radio frequency energy, wherein said third antenna element and said fourth antenna element are situated in a tapered slot antenna pair configuration;

at least one conductive launch structure, electrically coupled to said first antenna element, said second antenna element, said third antenna element and said fourth antenna element at a location between a lowest operating frequency phase center and a launch end of said tapered slot antenna pair configurations, capable of conducting electricity.

17. An apparatus, comprising:

eight pairs of tapered slot antennas having a cylindrical configuration;

eight conductive launch structures wherein each conductive launch structure of said eight conductive launch structures electrically couples a unique pair of said eight pairs of tapered slot antennas.

* * * * *